US007323075B1

(12) United States Patent
Sagan et al.

(10) Patent No.: US 7,323,075 B1
(45) Date of Patent: Jan. 29, 2008

(54) METHOD OF CONTOURING FABRIC USING HALF-HARD BRASS

(75) Inventors: Mary Jo Sagan, Riverside, CA (US); Dee Waddell, Riverside, CA (US); Todd M. Greer, Fontana, CA (US); Franklin Mitchell Keller, Riverside, CA (US)

(73) Assignee: Jo Dee's, Inc., Las Vegas, NV (US)

( * ) Notice: Subject to any disclaimer, the term of this patent is extended or adjusted under 35 U.S.C. 154(b) by 0 days.

(21) Appl. No.: 11/233,925

(22) Filed: Sep. 23, 2005

Related U.S. Application Data

(63) Continuation of application No. 10/309,780, filed on Dec. 3, 2002, now abandoned.

(60) Provisional application No. 60/337,253, filed on Dec. 3, 2001.

(51) Int. Cl.
*B32B 15/06* (2006.01)
*B32B 7/12* (2006.01)
*B32B 15/082* (2006.01)

(52) U.S. Cl. ..... 156/196; 156/212; 2/255; 428/344

(58) Field of Classification Search ..... None
See application file for complete search history.

(56) References Cited

U.S. PATENT DOCUMENTS 758,923 A 5/1904 Knowlton et al.
2,474,552 A 6/1949 Steinmeyer
3,001,578 A 9/1961 Ratliff
3,577,307 A 5/1971 Baier et al.
3,819,467 A 6/1974 Kovac
3,832,598 A 8/1974 Oehmke et al.
4,073,331 A 2/1978 Zilver
4,119,134 A 10/1978 Morken
4,461,666 A * 7/1984 Kohn ..... 156/222
4,496,444 A 1/1985 Bagnulo
4,610,906 A 9/1986 Brooks
4,698,457 A 10/1987 Bordbar
4,942,084 A * 7/1990 Prince ..... 428/464
4,963,411 A 10/1990 Protz, Jr.
4,977,296 A 12/1990 Hemming
5,680,655 A * 10/1997 Watanabe ..... 2/227
5,702,994 A 12/1997 Klosel
5,916,652 A 6/1999 Miner et al.
6,023,881 A 2/2000 Kollath et al.
6,235,385 B1 5/2001 Lee

* cited by examiner

*Primary Examiner*—Richard Crispino
*Assistant Examiner*—Barbara J Musser
(74) *Attorney, Agent, or Firm*—Knobbe, Martens, Olson & Bear LLP

(57) ABSTRACT

A device for shaping and contouring a fabric or the like in sewing and handicraft projects. In one configuration, the device includes a strip of solid and ductile metal that is configured to be directly adhered to a fabric surface. At lease one layer of acrylic pressure-sensitive adhesive is formed on a bonding of the metal. The shaping device can be bent into various contours and is strong enough to cause material such as tapestry or balsa wood to assume the contours of the shaping device.

3 Claims, 3 Drawing Sheets

METHOD OF CONTOURING FABRIC USING HALF-HARD BRASS

RELATED APPLICATION

This application is a continuation application of U.S. application Ser. No. 10/309,780 filed Dec. 3, 2002, which claims priority to U.S. Provisional Patent Application No. 60/337,253, filed Dec. 3, 2001. Each of these applications is incorporated by reference herein in its entirety.

BACKGROUND OF THE INVENTION

1. Field of the Invention

The present invention generally relates to methods and apparatus for use in sewing and creating handicraft projects, and more particularly, to a method and apparatus for stiffening and shaping fabrics and other materials that lack in structure and rigidity.

2. Description of the Related Art

In various sewing and handicraft projects, it is often desirable to shape the edge of a piece of cloth or other fabric-like material into various contours. For example, it is sometimes desirable to incorporate a ruffle-like appearance to the hem of a curtain or to maintain wave-like folds in a soft textured material such as felt. Moreover, some arts and crafts projects may involve shaping a fabric or other pliable material into a specific design such as a house or teepee. Additionally, it may also be desirable to create folds or pleats in costumes and the like.

However, it is generally known that materials such as fabric, upholstery, yam, and felt tend to lack rigidity due to the inherent characteristic of the material. The lack of rigidity in these materials makes providing the material with semi-permanent shapes and contours difficult. To address this problem, U.S. Pat. No. 3,819,467 discloses a laminated, self-sticking tape comprised of a core material made of aluminum mesh and a strip of non-woven fabric material completely covering each side of the wire mesh core. The tape can be applied to a fabric and then creased to help the fabric hold the folds and other configurations. However, the core material being made of an aluminum mesh is not sufficiently strong to hold the shape of heavier materials such as tapestry. Moreover, the mesh-like material can only be adhered to fabric when the mesh is laminated with two strips of fabric. The additional strips of fabric add to the thickness of the tape and thus reduce the flexibility in manipulating the shape of the creasible core. In fact, the aluminum mesh is difficult if not impossible to directly apply to a fabric surface.

Hence, in view of the foregoing, there is a need for a shaping device for sewing and handicraft projects that can shape and contour fabrics and other pliable materials. To this end, there is a particular need for a shaping device having a rigid portion that can be directly adhered to a fabric surface and is sufficient strong to maintain contours in heavier material such as tapestry.

SUMMARY OF THE INVENTION

In one aspect, the preferred embodiments of the present invention comprises a shaping device for forming contours in an article, such as drapery. The shaping device includes a shaping layer comprised of a solid strip of metal having a first bonding surface. In one embodiment, the width of the metal is at least ¼ inch. The shaping device further comprises a first adhesive layer formed on the bonding surface of the shaping layer. Preferably, the adhesive layer comprises an acrylic compound that wets the bonding surface of the shaping layer and forms a physical bond with the shaping layer. Moreover, the shaping device further comprises an article wherein the article is bonded to the shaping layer by forming a bond with the adhesive layer.

Preferably, the shaping layer has sufficient ductility to be bent into a first contour and sufficient strength to impart the first contour to the article. In one embodiment, the shaping layer is made of brass and the adhesive layer comprises a substantially acid-free and lignin-free acrylic adhesive. The article may include, but is not limited to, a woven fabric, tapestry, or balsa wood. In yet another embodiment, the shaping device further comprises a second adhesive layer that is bonded to a second bonding surface on the shaping device. Preferably, the first adhesive layer in conjunction with the second adhesive layer simultaneously bond the shaping layer to opposing sides of the article.

In another aspect, the preferred embodiments of the present invention comprise a method of providing shape and contour to an article such that drapery or other materials made of fabric. The method comprises forming a solid and ductile strip of material having a bonding surface; applying a layer of adhesive to the bonding surface; adhering the bonding surface of the strip of material to an article by forming a bond between the adhesive layer and the article; and bending the strip of material into a first contour wherein the material imparts the first contour.

In yet another aspect, the preferred embodiments of the present invention comprise a device for contouring and providing stiffness to a fabric. The device comprises a strip of metal in a first configuration, wherein the metal can be bent into a second configuration and then restored to the first configuration. The device further comprises a layer of adhesive having a first and a second surface, wherein the first surface of the adhesive is formed directly onto a bonding surface of the strip of metal. Moreover, the second surface of the adhesive is bonded to a fabric surface in a manner such that when the metal is bent into the second configuration, the fabric surface also assumes the second configuration and when the metal is restored to the first configuration, the fabric surface is restored to the first configuration.

Advantageously, the shaping device of the preferred embodiments provide a rigid shaping device that can be directly bonded to a fabric surface via an adhesive. Moreover, the adhesive preferably is selected for its ability to form a strong bond with both metal and fabric surfaces as well as withstand exposures to heat and sunlight without substantial degradations. Furthermore, the shaping device is ductile and yet sufficiently strong to impart its contours to all types of fabrics including heavy tapestry.

DETAILED DESCRIPTION OF THE PREFERRED EMBODIMENT

Figure 1:
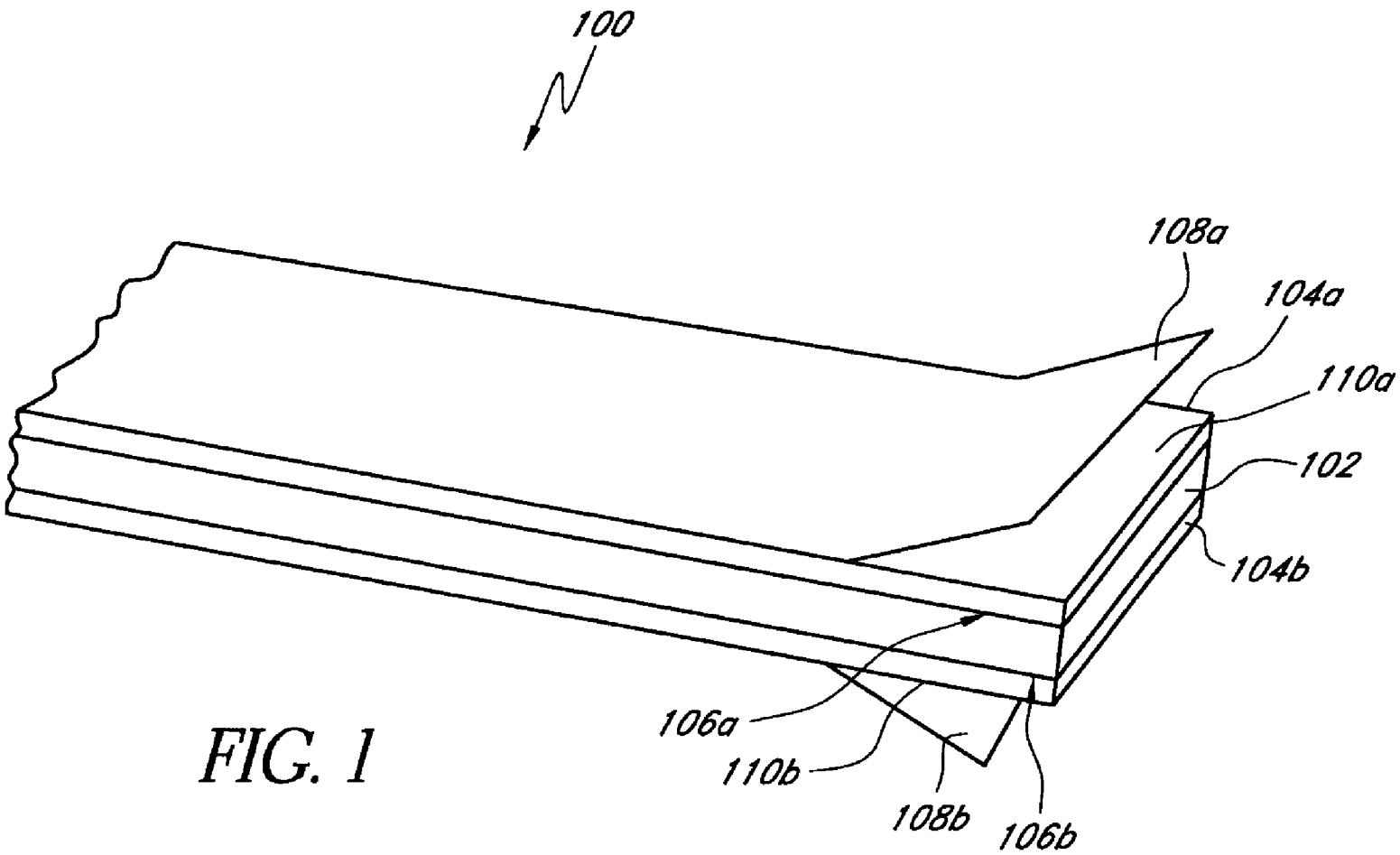
FIG. 1 is a schematic illustration of one preferred embodiment of the shaping device of the present invention.

Reference will be made to the drawings wherein like numerals refer to like parts throughout. FIG. 1 provides a schematic illustration of a shaping device 100 of one preferred embodiment of the present invention. It is to be understood that for the purpose of illustration, the dimensions of the device are not drawn to scale. As shown in FIG. 1, the shaping device 100 generally comprises a shaping layer 102 that is formed of a solid metal, plastic, or polymer based material that can be easily bent or deformed into various configurations. As will be described in greater detail below, the material selected for forming the shaping layer 102 is preferably sufficiently ductile, formable and yet strong and rigid enough to shape sections of heavy cloth such as tapestry or even substantially rigid materials such as balsa wood into the contours of the shaping layer 102. The shaping layer 102 can be between about ⅛ inch to 4 inches thick, or any other suitable width.

In one embodiment, the shaping layer 102 comprises a solid strip of half-hard brass between about 0.01 to 0.04 inch thick. Applicant has found the half-hard brass as being the most preferred embodiment because the material is sufficiently ductile and formable at room temperature and yet can withstand repeated bending in different directions without becoming damaged. Moreover, the half-hard brass also has sufficient strength to bend and shape heavy cloth and other materials.

As also shown in FIG. 1, the shaping device 100 further comprises a first and second adhesive layers 104*a*, 104*b* that are formed on a first and second surface 106*a*, 106*b* of the shaping layer 102. The adhesive material is preferably selected for its ability to withstand temperatures above 80 C. and constant exposure to sunlight. Moreover, the adhesive material is preferably selected for its ability to establish a strong bond to both a metal surface and a fabric surface such as that of brass and tapestry, or between brass and balsa wood. Most known shaping forming devices that are made of metal generally do not directly adhere to a fabric surface. This may be due to the lacking of a suitable adhesive that can form a strong bond between a metal surface as well as a woven fabric surface.

In one preferred embodiment, the adhesive layers 104*a*, 104*b* comprise an acrylic pressure sensitive adhesive that is substantially acid-free, lignin-free, and pH-neutral. Advantageously, the preferred adhesive composition is selected for its ability to bond to a metal surface as well as a fabric surface. Moreover, the preferred adhesive composition forms a bond that can withstand exposures to high temperature and sun light without significant degradation.

In another preferred embodiment, the adhesive layers can be adhesives sold under the trademark of High Tack Adhesive made by 3M Company. Preferably, the first and second adhesive layers 104*a*, 104*b* are each between about 0.003 to 0.005 inch thick. The adhesive layers 104*a*, 104*b* can be coated onto the first and second surface of the shaping layer 102 using methods known in the art. As FIG. 1 further shows, the shaping device 100 also comprises a first and second release sheet 108*a*, 108*b* that are formed on an upper surface 110*a*, 110*b* of the adhesive layers 104*a*, 104*b* to protect the adhesive layers from being damaged.

Figure 2:
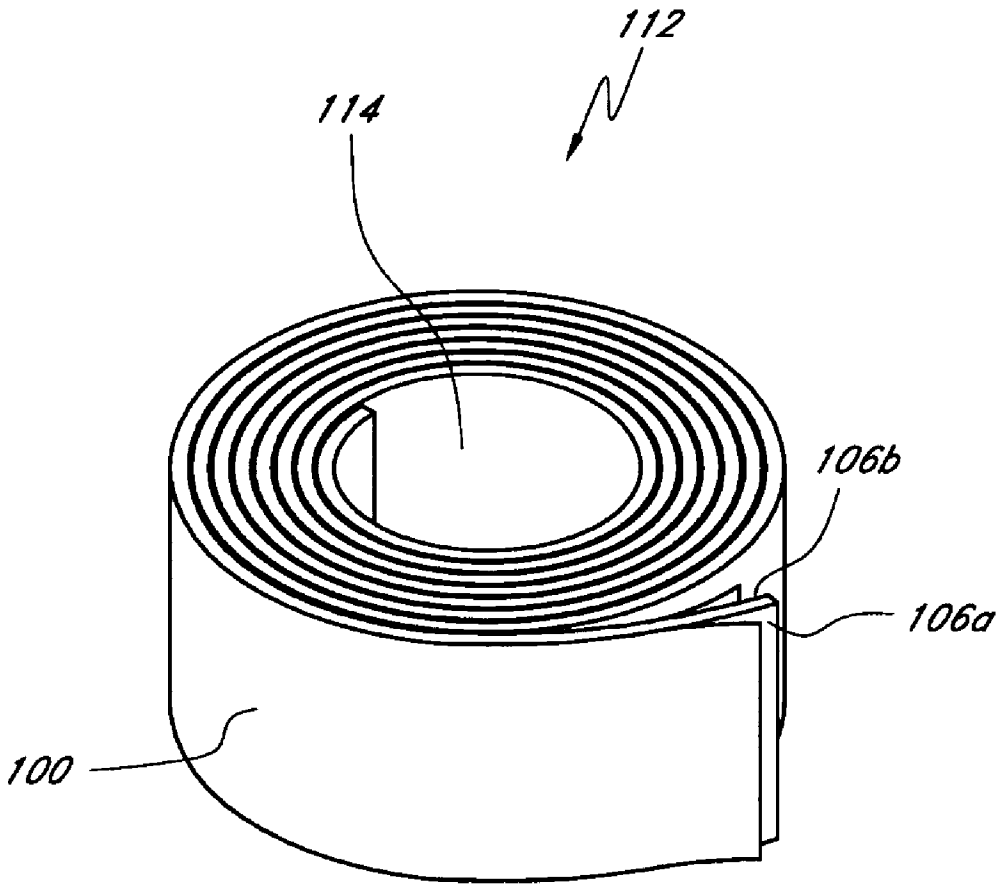
FIG. 2 is a schematic illustration of the shaping device of FIG. 1 stored in coil form for easy handling.

FIG. 2 shows that the shaping device 100 can be formed into a coil 112 for convenient handling and ease of use. Preferably, the shaping device 100 is wound is such a way that at least one of the adhesive layers 106*b* face inward toward the center 114 of the coil 112. This way, the user can unwind the shaping device 100 while applying pressure to the device 100 so that the adhesive 106*b* bonds to the bonding surface.

Figure 3:
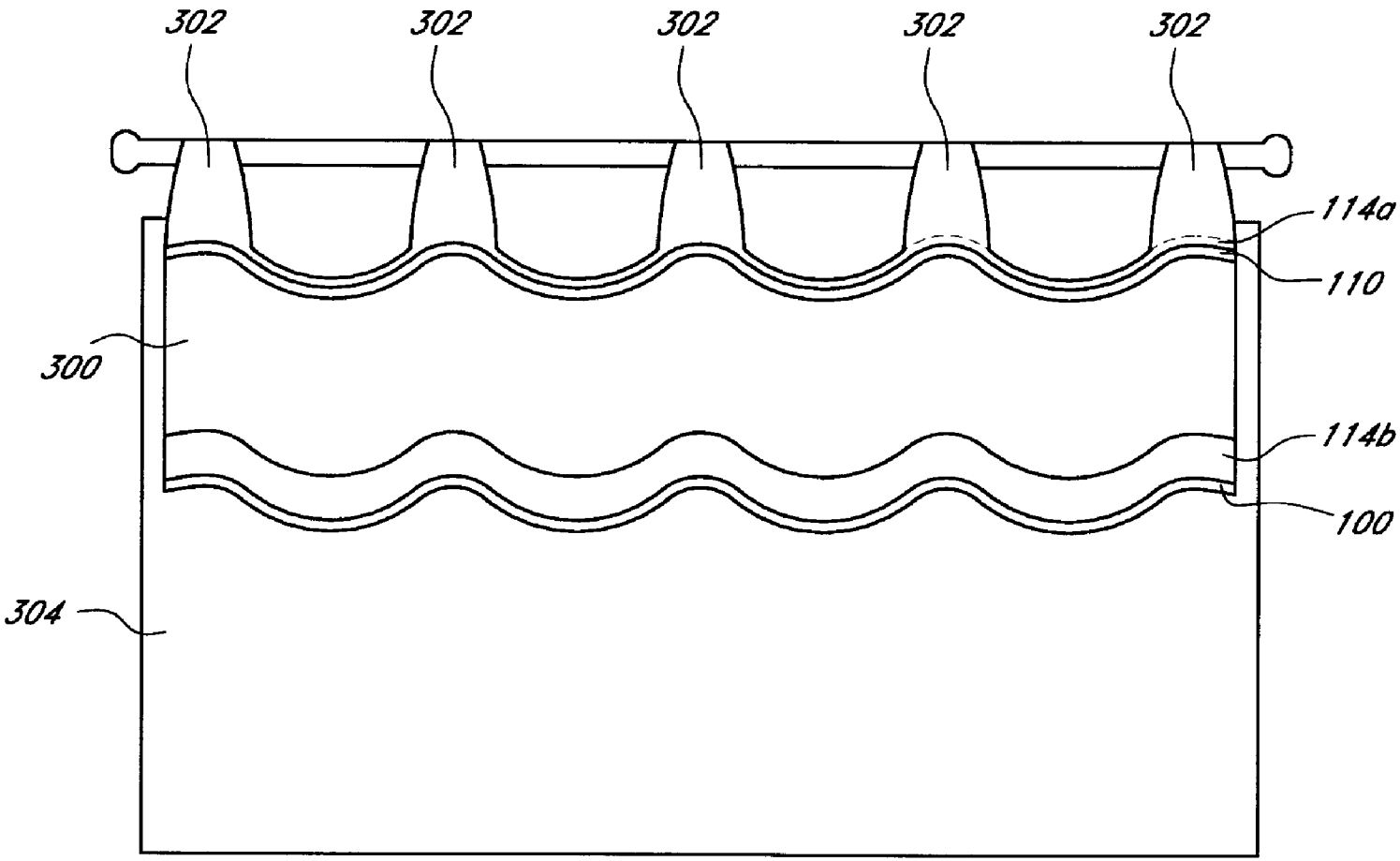
FIG. 3 is a schematic illustration of the shaping device of FIG. 1 incorporated into a valance.

As shown in FIG. 3, the shaping device 100 can be applied to an upper and lower hem 114*a*, 114*b* of a valance 300 hanging adjacent a window 304. As shown in FIG. 3, the valance 300 has a plurality of tabs 302 attached to the upper hem 114*a*. It is generally known that tabs on a valance tend to cause some valances to lean inwardly toward the window. Advantageously, the shaping device 100 of the preferred embodiment provides a continuous strip of rigid yet ductile shaping layer that can be inserted and adhered to the hem of the valance. As shown in FIG. 3, the shaping device 100 is first inserted into the hem 114*a*, 114*b* of the valance 300. Preferably, heat and pressure are then applied to the hem to adhere the shaping layer to the fabrics of the hems. In one embodiment, the acrylic adhesive forms a mechanical bond between the fabric and the upper and lower surfaces of the shaping layer.

The shaping device 100 is then bent and formed into a wave-like configuration as shown in FIG. 3 so as to cause parts of the valance to extend outwardly. Advantageously, the shaping device 100 provides the valance 300 with the desired contours that extend across the entire length of the valance 300. In one embodiment, the length of the valance is at least 30 inches. Moreover, the shaping device 100 can be reshaped to a different configuration so as to provide the valance 300 with a different contour. However, it can be appreciated that the shaping device 100 is not limited to being positioned adjacent upper or lower hem of the valance. Furthermore, the shaping device 100 is not limited to applications for valances or drapery. The shaping device 100 can be used to provide form and contour to materials such as heavy tapestry, balsa wood, and the like. As such, the shaping device has applications in various handicraft projects.

Although the preferred embodiments of the present invention has shown, described and pointed out the fundamental novel features of the invention as applied to this embodiment, it will be understood that various omissions, substitutions and changes in the form of the detail of the device illustrated may be made by those skilled in the art without departing from the spirit of the present invention. Consequently, the scope of the invention should not be limited to the foregoing description, but should be defined by the appending claims.

What is claimed is:

1. A method of providing shape and contour to a fabric, comprising:

forming a solid and ductile strip of material having a bonding surface, wherein the material comprises a solid strip of half-hard brass;

applying a layer of adhesive to the bonding surface, wherein the layer of adhesive comprises a substantially acid-free and lignin-free acrylic adhesive, wherein the adhesive is adapted to form mechanical bonds with the half-hard brass and the fabric material;

adhering the bonding surface of the strip of material to the fabric by forming a bond between the adhesive layer and the fabric; and bending the strip of material into a first contour wherein the material imparts the first contour onto the fabric by exerting a pulling force on the fabric via the bond formed between the adhesive layer and the fabric.

2. The method of claim 1, wherein adhering the bonding surface of the strip of material to the fabric comprises applying heat and pressure to the strip of material.

3. The method of claim 1, wherein adhering the bonding surface of the strip of material to the fabric comprises inserting the strip of material into a hem section of the fabric.

* * * * *